United States Patent [19]

Scheinhaus et al.

[11] 4,200,997

[45] May 6, 1980

[54] SANDAL

[76] Inventors: Myron G. Scheinhaus, 11213 Tiara St., North Hollywood, Calif. 91601; Paul R. Jacobson, 10641 Stagg St., Sun Valley, Calif. 91352

[21] Appl. No.: 879,139

[22] Filed: Feb. 21, 1978

[51] Int. Cl.[2] ..... A43B 3/12

[52] U.S. Cl. ..... 36/11.5

[58] Field of Search ..... 36/11.5, 97, 50; 2/DIG. 6

[56] References Cited

U.S. PATENT DOCUMENTS

| | | | |
|---|---|---|---|
| 2,259,273 | 10/1941 | Smith | 36/11.5 |
| 2,642,677 | 6/1953 | Yates | 36/11.5 |
| 3,675,346 | 7/1972 | Miyachi et al. | 36/11.5 |
| 4,069,601 | 1/1978 | Robbins et al. | 36/11.5 |

OTHER PUBLICATIONS

Footwear News; 5-4-70; P.N.R. 1080.

*Primary Examiner*—Patrick D. Lawson

*Attorney, Agent, or Firm*—Sellers and Brace

[57] ABSTRACT

A sandal having a multi-layer sole including an insole of mini-cell foam which takes a set conforming to the sole of the wearer's foot. A pair of straps have their remote ends anchored to the opposite sides of the sole assembly with portions of each looped about the foot and freely movable lengthwise of a pair of passages traversing the sole assembly interiorly of its shank portion to the extent necessary to grip the foot comfortably when the adjacent free ends of the straps are secured together in any selected overlapped relation.

22 Claims, 4 Drawing Figures

SANDAL

This invention relates to an article of footwear, and more particularly to a unique sandal having a multi-layer sole assembly including an arch support and improved strap means for holding the sandal to the foot including provision for both straps to shift crosswise of the sole assembly.

BACKGROUND OF THE INVENTION

There has been a profusion of prior sandal designs embodying a wide variety of construction concepts for both the sole assembly and the strap means holding the sole assembly to the wearer's foot.

Designs proposing strap expedients having some degree of relevance to the present invention include Wermark U.S. Pat. No. 2,038,151, Perugia U.S. Pat. No. 2,136,084, Smith U.S. Pat. No. 2,259,273 and Farley U.S. Pat. No. 3,001,302. In each, the straps embrace the foot including the toe area as well as the heel and arch. Smith's shows a single strap 2 embracing the wearer's toes and having portions 21 and 23 passing across the sandal beneath the insole but without any provision for shifting the strap crosswise of the sole assembly and lacking any appreciation of the advantages to be gained by providing for such relative movement. Wermark shows a sandal having a pair of straps secured to the opposite forward ends of the sole and then wrappable spirally in opposite directions about the shank and the ankle. This construction exposes the portions of the straps to contamination and soiling beneath the sandal and it is difficult and time consuming to wrap the two straps in opposite directions several times about the foot and sole. Each of the other patents show strapping which is secured in several areas along the opposite sides of the sole without provision for adjustment of the straps relative to one another except that possibly permitted by elastic inserts. Additionally, no one of these prior constructions embodies the arch support or an insole having the capability of conforming to the sole of the wearer's foot.

SUMMARY OF THE INVENTION

This invention provides a novel article of footwear comprising a sample having a multi-layer sole assembly including an arch support and an insole made of material which takes a generally permanent set conforming to the sole of the wearer's foot. Another important feature is a pair of straps having loops embracing the forward end of the foot as well as the heel and arch and each including portions extending freely through passages in the sole assembly permitting equalization of pressure between all portions in contact with the wearer's foot. This important objective is achieved in part by separable fastenings between the free ends of the two straps permitting these ends to be secured together in any one of a multitude of positions and readily separated by a simple peeling operation. The foot arch and heel are embraced in part by a heel loop and in part by a figure-eight loop of the straps, the size of each of which loops is free to change as necessary for most comfortable wear.

Accordingly, it is a primary object of this invention to provide a unique sandal having a specially constructed sole assembly provided with internal transverse passages enclosing mid-length portions of strapping and which strapping includes portions embracing the toes, arch and heel and permitting shifting of the straps as necessary for maximum wearing comfort.

Another object of the invention is the provision of an improved sandal having multiple layers of closed-cell foam material and including an insole of mini-cell foam material which takes a set in conformity with the wearer's foot and an outsole of long-wearing abrasion-resistant material.

Another object of the invention is the provision of a sandal having a multi-layer sole assembly designed to provide a firm stable support for the heel and arch and the toe end of which is relatively flexible.

Another object of the invention is the provision of a simple inexpensive sandal held to the foot by a pair of straps providing a plurality of loops embracing the toes, heel and ankle with each loop free to adjust in length as necessary to equalize the pressure on all areas of the foot in contact therewith.

Another object of the invention is the revision of an improved sandal utilizing a pair of relatively adjustable retaining straps embracing different portions of the wearer's foot and having their free ends securable in any of a multitude of different positions.

These and other more specific objects will appear upon reading the following specification and claims and upon considering in connection therewith the attached drawing to which they relate.

Referring now to the drawing in which a preferred embodiment of the invention is illustrated:

Figure 1:
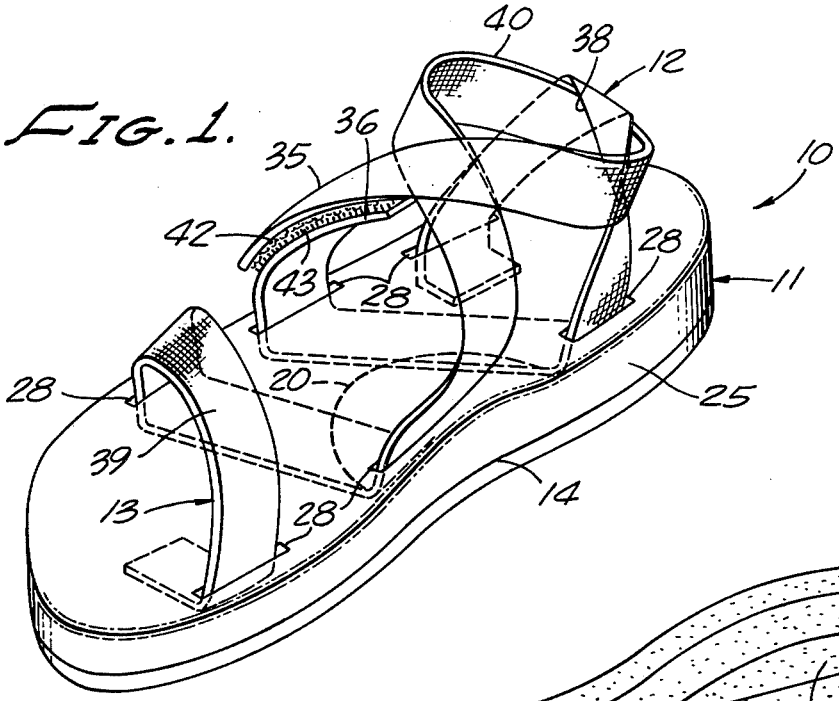
FIG. 1 is a perspective view of an illustrative embodiment of the invention sandal showing the retaining straps in closed position.
Figure 4:
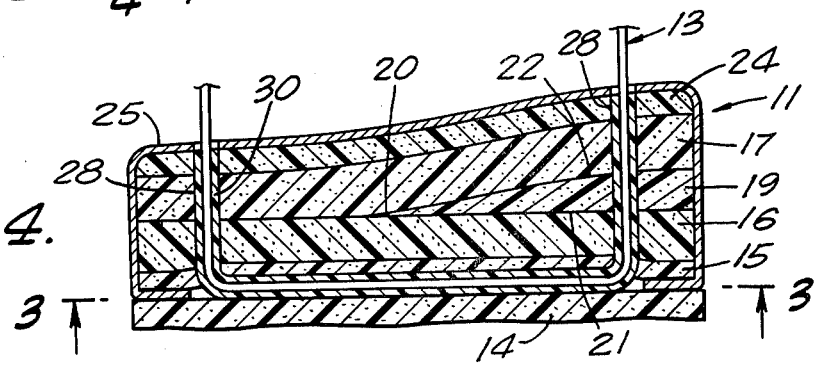
FIG. 4 is a cross-sectional view taken along line 4—4 on FIG. 3 after the outsole has been secured in place.

Referring more particularly to FIG. 1, there is hown an illustrative embodiment of the invention sandal, designated generally 10, having a sole assembly 11 held to the foot by a pair of straps 12 and 13. The sole assembly 11 is best shown in FIG. 4 as including an outsole 14 of abrasion and wear resistant material of any suitable type well known to the footwear art. Superimposed on and laminated to sole 14 is a typical mid-sole there shown as comprising three layers 15, 16 and 17 of closed-cell spongy, resilient material. Layer 16 is bevelled or tapered, as is clearly indicated at 18, with the forward edge of the bevel terminating in a sharp edge extending transversely of the sandal rearward of but closely adjacent the ball of the foot. In consequence the forward or toe end of the sandal flexes with ease even when worn for the first time.

Figure 2:
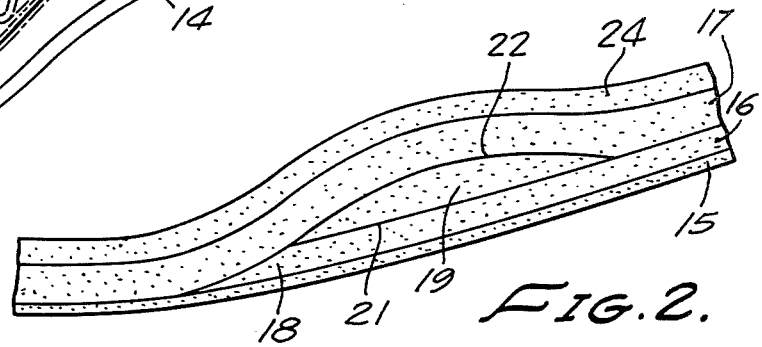
FIG. 2 is a fragmentary side elevational view of the shank portion of the sole assembly as viewed along the inner lateral side thereof.
Figure 3:
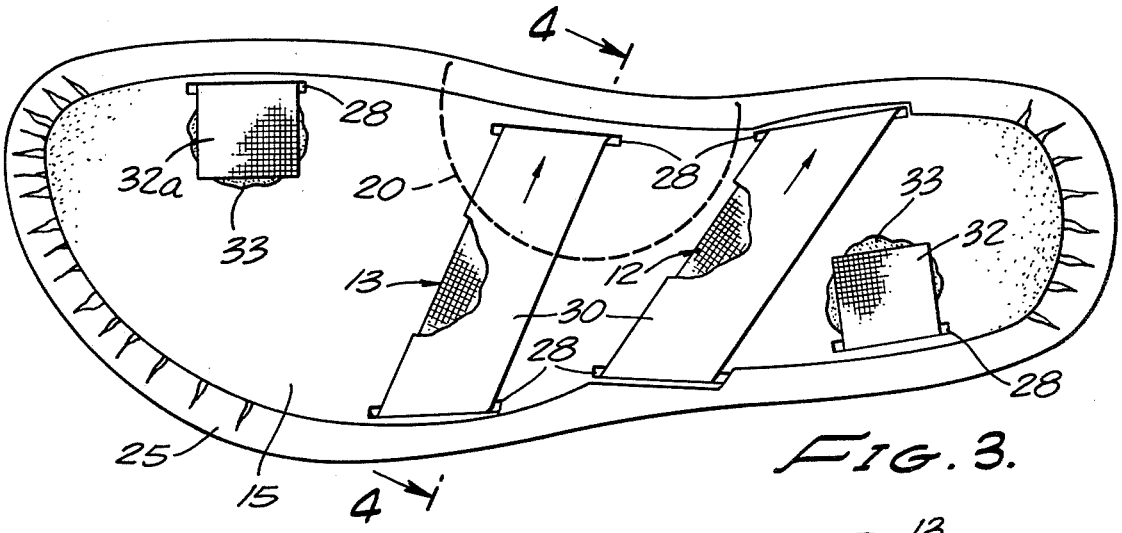
FIG. 3 is a plan view of the sole assembly as viewed along line 3—3 on FIG. 4 prior to assembly of the outsole and showing portions of the lining for the strap passage broken away.

The sandal is also preferably provided with an arch support 19. This may be made of the same materials as layers 16 and 17. The arch support is semi-circular in contour as indicated by the dotted line 20 in FIG. 3 and is plano-convex in shape with its plano surface 21 facing downwardly and its convex upper surface facing upwardly. The semi-circular perimeter 20 is sharp-edged and merges flush with the opposed surfaces of layers 16 and 17 as is made clear by FIGS. 2 and 4.

An important component of sole assembly 11 comprises the insole layer 24 which is preferably formed of mini-cell foam material obtainable from Voltech, Lawrence, Mass., and designated L-200 by that firm. This material has the characteristic of being self-molding in that it acquires a generally permanent set conforming with the configuration of the wearer's foot after a very short period of wear. This layer along with layers 16, 17 and 19 are secured or laminated together as with a suitable bonding adhesive. If desired, all except the insole layer may be left uncovered and exposed, or alternatively these layers may be enclosed by a suitable covering layer of leather or other material 25. Layer 25 is bonded in place and the perimeter edges are turned inwardly and bonded to the lowermost mid-sole layer 15.

Whether the mid-sole and insole are left covered or uncovered, the sole sub-assembly is next punched to provide elongated slots 28 opening vertically through the entire assembly and sized to accommodate straps 12 and 13. The two pairs of slots 28 crosswise of the shank portion of the sole assembly are then provided with lengths of thin smooth-surfaced flexible tubing 30. This tubing provides a lining for slots 28 and is of a size readily accommodating straps 12 and 13 thereby providing a smooth surface passage along which these straps can be readily adjusted. Initially and during manufacturing the opposite ends of the lining 30 projects substantially above the upper surface of the sole assembly to aid in threading straps 12 and 13 through these tubes. After the straps have been installed and sole 14 has been bonded to lining 30 and to the bottom of the mid-sole assembly, the exposed ends of the lining are severed flush with or below the upper surface of insole 24.

Straps 12 and 13 may be made of any suitable material such as webbing, leather, plastic or the like. As best appears from FIG. 3, the rear end 32 of strap 12 is installed through the rearmost slot 28 and is firmly bonded or anchored to the underside of the mid-sole assembly by adhesive 33. Likewise, the foremost end of strap 13 is installed through the forward slot 28 and is similarly firmly anchored to the mid-sole by adhesive 33. Usually tubes 30 are threaded over straps 12 and 13 before being threaded through the two pairs of centrally located slots 28. This have been done the outsole 14 is bonded to the lower surface of the mid-sole in an operation preferably carried out under pressure until the bonding agent has taken a firm set.

It will be noted that the remote ends 32 and 32*a* of strips 12 and 13 are anchored to the mid-sole at the opposite ends thereof and adjacent the opposite lateral edges thereof. Likewise, it will be noted from FIG. 3 that the two pairs of slots 28 located along the opposite side of the shank portion of the sole assembly are staggered so that the two linings 30 interconnecting these pairs are inclined acutely to the longitudinal axis thereof. In consequence the rearmost portion of strap 12 forms a heel embracing loop 38 having a half twist and the foremost portion of strap 13 forms a toe embracing loop 39. The rear end portion of strap 13 is threaded through the heel embracing loop 38 as shown in FIG. 1, or through a retainer loop connected with the upper portion of loop 38. Hence the exposed rear end portion of strap 13 is accurately described when its end 35 is secured to strap 36 as forming a FIG. 8 operatively connected to loop 38. Thus the connection between loops 38 and 40 serves to hold loop 40 from rising along the ankle while at the same time placing loop 38 in tension and snugly about the heel.

The free ends 35 and 36 of straps 12 and 13 are preferably provided with separable fastener means readily and securely interlockable when pressed together in overlapping relation.

Such fastener means are well known in commercial channels and include a multiplicity of barbs 42 affixed to the underside of strap end 35. These barbs readily interlock with a shallow mat of randomly arranged fibers 43 secured to the upwardly facing surface of strap end 36 but are readily peeled away from fibers 43 in known manner.

The sandal is applied to the foot in an obvious manner while strap ends 35, 36 are separated, it being understood that the forward end of the foot is inserted through the open loop 40 while that loop is assembled through heel loop 38. Once the foot is in place strap 35 is wrapped snugly about the forward face of the foot arch whereupon the strap ends 35, 36 are pressed together in overlapping interlocking relation. Each of the straps 12, 13 then quickly adjust themselves lengthwise of the passage liners 30, 30. If the straps are too tight or too loose ends 35, 36 are peeled apart and reclosed in a desired new position.

While the particular improved sandal herein shown and disclosed in detaily is fully capable of attaining the objects and providing the advantages hereinbefore stated, it is to be understood that it is merely illustrative of the present preferred embodiment of the invention and that no limitations are intended to the detail of construction or design herein shown other than as defined in the appended claims.

We claim:

1. A sandal comprising:

a sole assembly having an insole and an outsole provided with first and second flattened passages arranged at an acute angle in the same direction crosswise of the midlength of said sole assembly;

first and second straps having their remote ends secured to the opposite edges of said sole assembly adjacent the opposite ends thereof;

said first strap having the rear end portion thereof forming a heel-embracing loop and its forward end portion passing through said first passage with the free end thereof exposed adjacent one side of said sole assembly;

said second strap having its forward end portion forming a toe-embracing loop before entering said second passage and having its rear end portion operatively connected with said heel-embracing loop and so arranged as to form a figure-eight loop about the wearer's heel and arch; and means for releasably securing the free ends of said first and second straps together.

2. A sandal as defined in claim 1 characterized in that said releasable securing means is constructed to hold said strap ends together in any of a multitude of different overlapped positions.

3. A sandal as defined in claim 1 characterized in that at least one of said first and second straps is free to shift lengthwise of the associated one of said first and second passages.

4. A sandal as defined in claim 1 characterized in that each of said first and second straps is free to shift lengthwise of the associated one of said first and second passages.

5. A sandal as defined in claim 3 characterized in that said first and second passages include a smooth lining throughout the major length thereof.

6. A sandal as defined in claim 4 characterized in that each of said first and second passages includes a smooth surfaced lining.

7. A sandal as defined in claim 1 characterized in that said sole assembly includes a midsole of spongy resilient material secured between said insole and outsole.

8. A sandal as defined in claim 7 characterized in that said midsole is substantially thicker at the heel end than at the toe end of said sole assembly.

9. A sandal as defined in claim 7 characterized in that said midsole includes a plurality of layers sandwiched between said insole and outsole and one of which layers has a wedge-shaped forward end terminating generally rearward of the ball of the wearer's foot.

10. A sandal as defined in claim 1 characterized in the provision of an arch support sandwiched between said insole and outsole along the inner lateral edge of said sole assembly said arch support being of plano-convex shape having a semi-circular tapered edge and a generally diametric thick edge, said thick edge lying flush with the inner lateral edge of said sole assembly.

11. A sandal as defined in claim 10 characterized in that said sole assembly includes a plural-layer midsole of resilient spongy material sandwiched against the opposite sides of said arch support and between said insole and said outsole.

12. A sandal as defined in claim 11 characterized in that said midsole comprises closed mini-cell spongy material.

13. A sandal as defined in claim 1 characterized in that said sole assembly includes an insole layer comprised of closed mini-cell foam material which, in use, acquires a generally permanent upwardly facing contour conforming to the shape of the juxtaposed surface of the wearer's foot.

14. A sandal as defined in claim 1 characterized in that the heel-embracing loop of said first strap has a half twist therein.

15. A sandal as defined in claim 14 characterized in that the rear end portion of said second strap is threaded through said heel-embracing loop adjacent the half twist therein.

16. A sandal as defined in claim 1 characterized in that said heel-embracing loop includes an inside leg and an outside leg each extending upwardly from a respective one of the inside and outside lateral edges of the heel end of said sole assembly, and said half twist being located along said inside leg.

17. A sandal comprising:

a sole assembly having a heel end and a toe end provided with a flattened passage arranged at an acute angle crosswise of the midlength of said sole assembly;

a strap extending through said passage and upwardly from the opposite ends thereof, one end of said strap being formed into a heel-embracing loop overlying said heel end and anchored to said sole assembly;

the other end of said strap being slidable lengthwise of said passage to adjust the size of said heel embracing loop; and means mounted over the toe end of said sole assembly to receive and embrace the toe end of a wearer's foot and including means for adjustably securing the same to said other end of said strap.

18. A sandal comprising separately manufactured components including:

an abrasion and wear resistant outsole;

an insole of self-molding closed mini-cell foam material which, in use, acquires a generally permanent set conforming to the juxtaposed surface of the wearer's foot;

a midsole of flexible resilient material sandwiched between and bonded to the adjacent surfaces of said outsole and said insole;

an appearance cover enclosing said insole and midsole and secured to said midsole; and means attached to the peripheral portions of said outsole and mid-sole for holding said sandal detachably in place on the wearer's foot.

19. A sandal sole assembly as defined in claim 18 characterized in that said midsole includes a plurality of layers one of which has a tapered forward edge terminating adjacent and rearwardly of the ball of the wearer's foot.

20. A sandal sole assembly as defined in claim 19 characterized in the provision of a semi-circular plano-convex arch support of resilient closed-cell spongy material sandwiched within that portion of the midsole lying along the inner side of the shank portion of said sole assembly with the convex side facing said insole.

21. A sandal sole assembly as defined in claim 18 characterized in that said midsole includes closed cell spongy material.

22. A sandal as defined in claim 1 characterized in that said first and second straps are interlooped at the heel end of said sandal.

* * * * *